United States Patent [19]

Gornik

[11] Patent Number: 4,995,749

[45] Date of Patent: Feb. 26, 1991

[54] APPARATUS FOR CLEANING A PAINT ROLLER PAD

[76] Inventor: Robert J. Gornik, 12235 Pacific Ave., #101, Los Angeles, Calif. 90066

[21] Appl. No.: 402,480

[22] Filed: Sep. 5, 1989

[51] Int. Cl.[5] ..... B08B 3/02; A46B 17/06

[52] U.S. Cl. ..... 401/9; 401/10; 401/137; 401/261; 15/1; 134/199

[58] Field of Search ..... 401/137, 261, 9, 10, 401/122, 11, 9; 15/1, 236.03, 104.4; 134/199, 149, 138

[56] References Cited

U.S. PATENT DOCUMENTS

| | | | |
|---|---|---|---|
| 2,625,944 | 1/1953 | Bloom | 134/199 |
| 2,985,178 | 5/1961 | Christensen, Jr. | 134/199 X |
| 3,608,120 | 9/1971 | Seiler | 15/1 |
| 3,707,740 | 1/1973 | Demers | 15/236.03 |
| 4,667,361 | 5/1987 | Wolcott et al. | 15/236.03 |
| 4,709,717 | 12/1987 | Rannigan et al. | 134/199 |

FOREIGN PATENT DOCUMENTS

| | | | |
|---|---|---|---|
| 2721212 | 11/1978 | Fed. Rep. of Germany | 15/236.03 |
| 793180 | 4/1958 | United Kingdom | 401/122 |

*Primary Examiner*—Steven A. Bratlie

*Attorney, Agent, or Firm*—Donald A. Kettlestrings

[57] ABSTRACT

Apparatus for cleaning a paint roller pad includes a hollow annular member and a plurality of semi-rigid or flexible nozzle elements projecting inwardly from an inner surface of the annular member with the free ends of the nozzle elements positioned to have an interference fit with the nap of the roller pad when the pad is passed between the nozzle elements. A connection is provided for introducing liquid into the interior of the hollow annular member, and an annular sleeve is attached to and in substantially coaxial relationship with the annular member. The sleeve provides an interference fit with the roller pad whereby paint and liquid are wiped and wrung from the roller pad as the pad is passed through the sleeve after passing in contact with the nozzle elements.

9 Claims, 3 Drawing Sheets

40
10
30
22
32
4
12
16
26
4
42
14
28
38
34
11

APPARATUS FOR CLEANING A PAINT ROLLER PAD

This invention relates to cleaning apparatus and more particularly to apparatus for easily, quickly and effectively cleaning a paint roller pad.

The use of roller applicators for quickly and evenly. applying paint is well known; however, cleaning the paint roller pad used with the applicator has been difficult. If the paint roller pad can be thoroughly, quickly and easily cleaned after each use, the pads can be reused many times. But, thorough, quick and easy cleaning of the paint roller pads has been difficult, and more pads than necessary have been used.

Although many devices have been developed to remove paint from paint roller pads, they have not proved entirely satisfactory because they have not quickly, easily and effectively removed paint from the base of the nap of the roller pad. If paint is not substantially completely removed from the base of the roller pad fabric or nap, the paint will harden and the life and efficiency of the paint roller pad will be significantly reduced.

It is, therefore, an object of the present invention to provide apparatus for cleaning a paint roller pad.

Another object is to provide apparatus which quickly, easily and effectively removes paint from the fabric or nap of the roller pad.

A further object of the invention is the provision of such apparatus which quickly, easily and effectively removes paint from the base of the paint roller pad fabric or nap.

Still another object is to provide such apparatus which forcefully applies water or other paint solvent directly to the base of the fabric or nap of the paint roller pad and simultaneously around the entire circumference of the roller pad.

Yet another object of the present invention is the provision of such apparatus which permits free and controlled circulation of water or solvent around and throughout the fabric or nap of the paint roller pad.

Another object is to provide such an apparatus which quickly and easily wipes and wrings paint and solvent liquid from the roller pad without the need for twisting or turning the pad as the pad is passed through the apparatus.

Yet another object of the present invention is the provision of such apparatus which includes splash guards for reducing and controlling the amount of spray and splashing of solvent and paint as the paint roller pad is passed through the apparatus.

A further object of the invention is to provide such apparatus which simultaneously cleans and wipes paint from the entire surface and the base of the fabric of the roller pad as the pad is passed through the apparatus.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides apparatus for cleaning a paint roller pad, the apparatus comprising: a first hollow annular member having an outer surface and a first inner surface, the inner surface defining a plurality of openings in fluid communication with the interior of the hollow member; a plurality of nozzle elements projecting inwardly from the inner surface and in fluid communication with the openings; free ends of the nozzle elements positioned to have an interference fit with the fabric or nap of the roller pad when the pad is placed between the nozzle elements; means in operative relationship with the hollow interior for introducing liquid into the interior; and an annular sleeve attached to and in substantially coaxial relationship with the first annular member, the sleeve defining a second inner surface having an interference fit with the roller pad whereby paint and liquid are wiped and wrung from the roller pad as the pad is passed axially through the sleeve after contact with the nozzle elements.

In accordance with the invention, the apparatus further includes a second annular member attached to and in substantially coaxial relationship with the first member for reducing the amount of spray and splashing of liquid and paint as the roller pad is passed through the apparatus.

It is to be understood that the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

Figure 1:
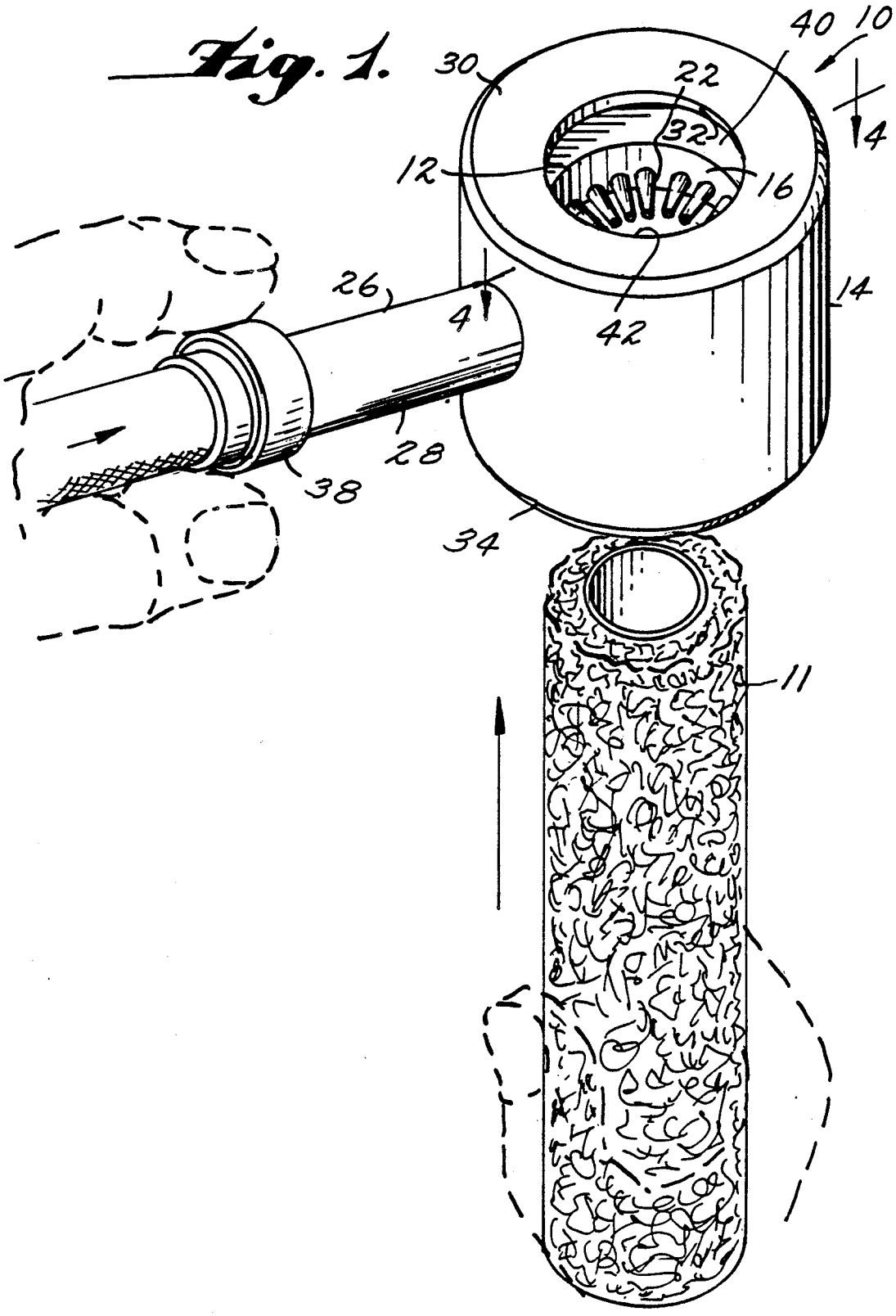
FIG. 1 is a perspective view of the cleaning apparatus illustrating a paint roller pad in position to be passed through the apparatus.
Figure 2:
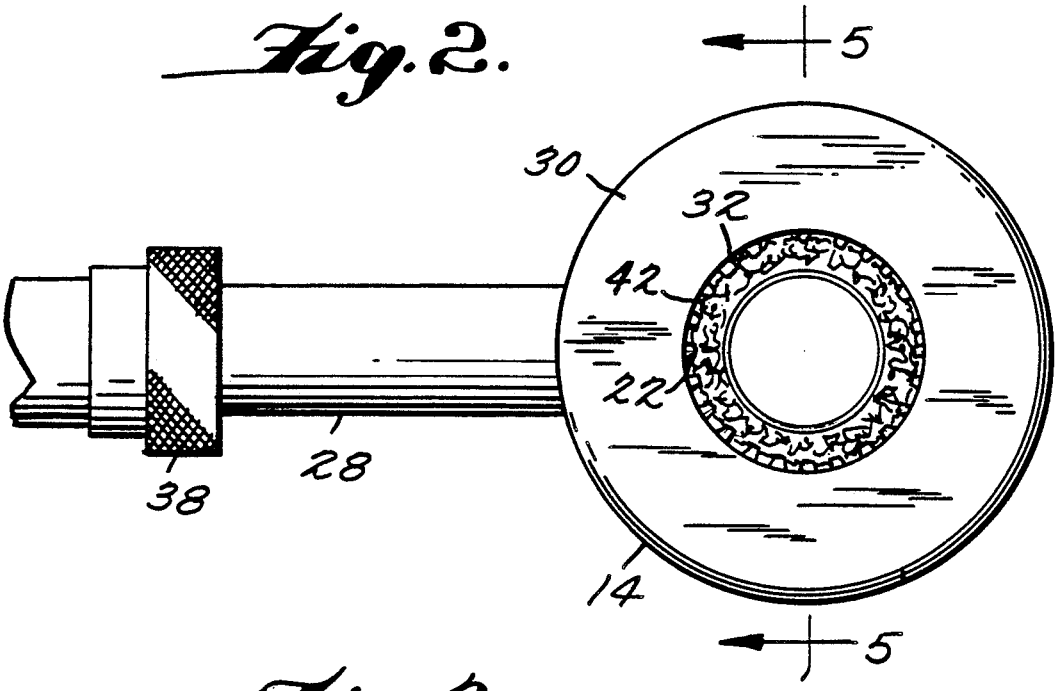
FIG. 2 is a top plan view of the apparatus and shows a paint roller pad in the position illustrated in FIG. 1.
Figure 3:
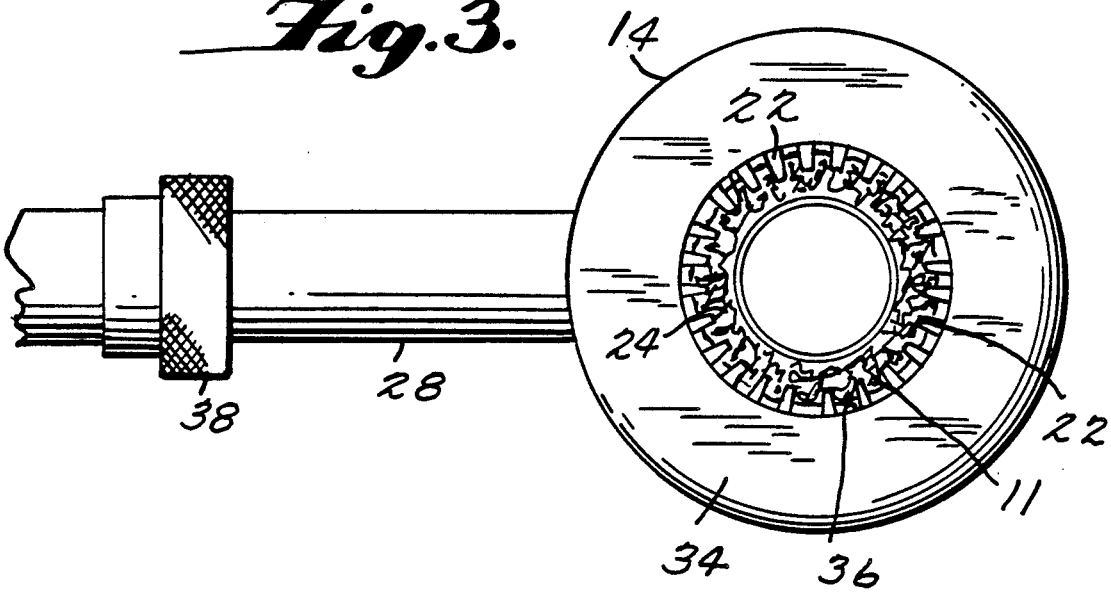
FIG. 3 is a bottom plan view of the apparatus and shows a paint roller pad inserted into the apparatus.
Figure 4:
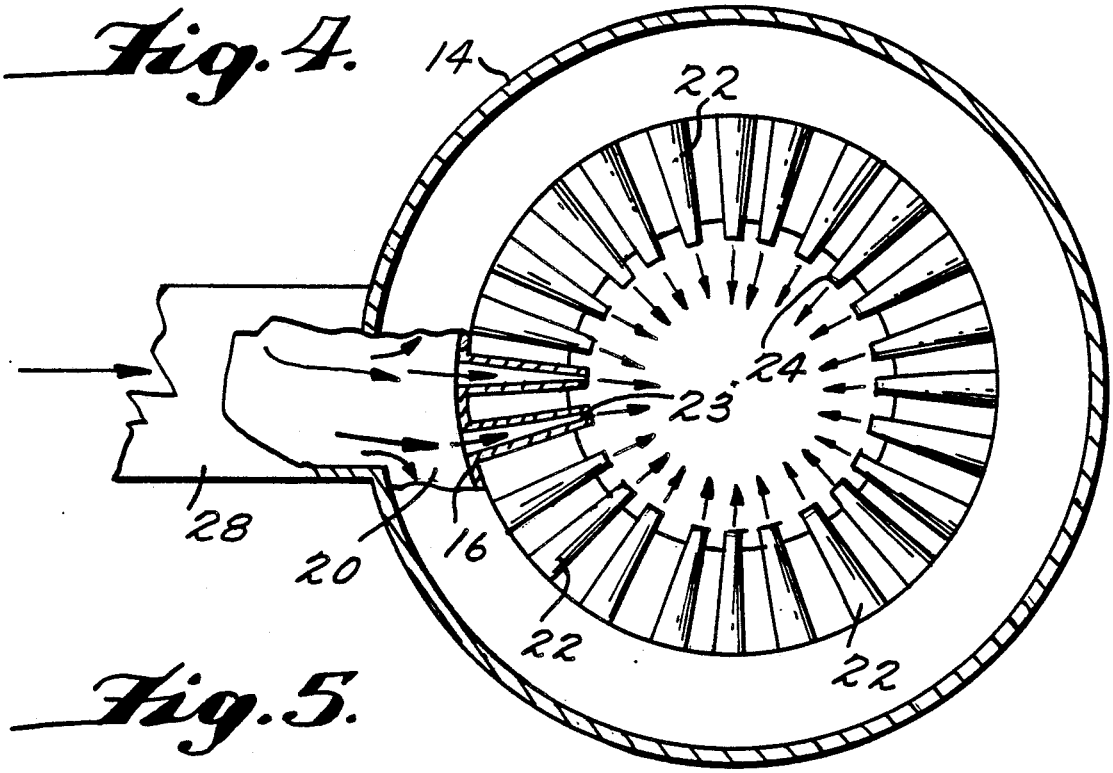
FIG. 4 is a cross-sectional view of the cleaning apparatus taken along the line 4—4 in FIG. 1 and looking in the direction of the arrows.
Figure 5:
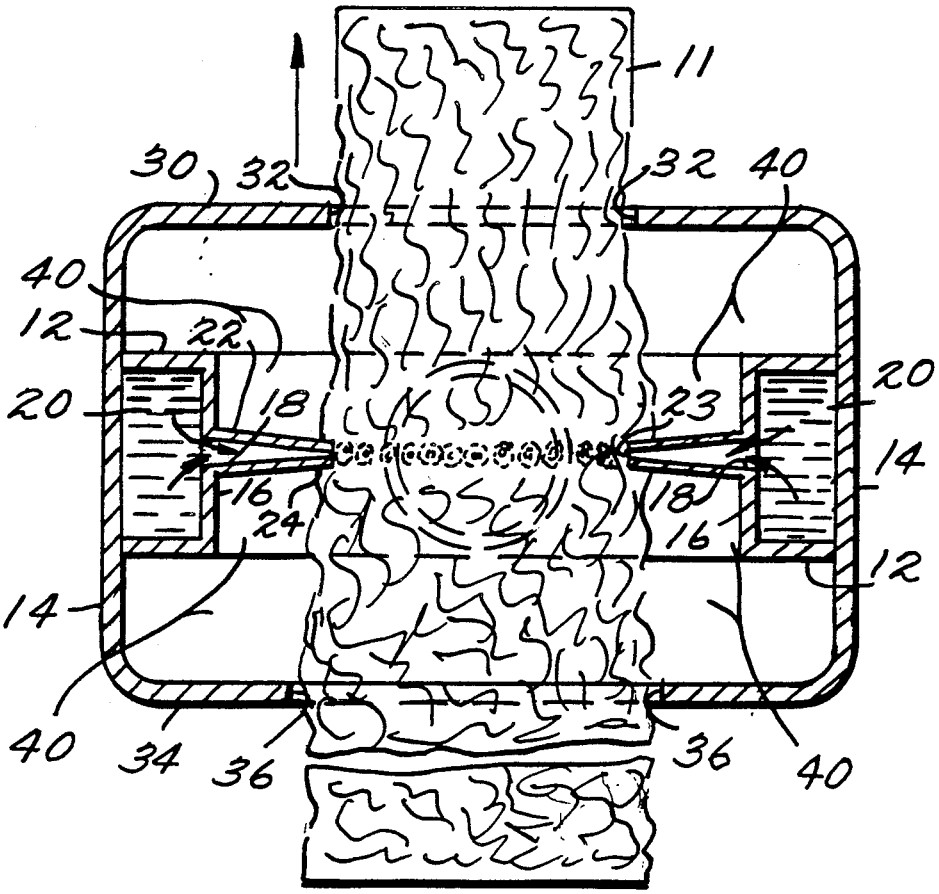
FIG. 5 is a cross-sectional view of the apparatus taken along the line 5—5 in FIG. 2 and looking in the direction of the arrows.

With reference now to the drawings, wherein like reference characters designate like or corresponding parts throughout the several views, there is shown apparatus 10 for cleaning a paint roller pad. Apparatus 10 is preferably comprised of injection-molded plastic and includes a first hollow annular member 12 having an outer surface 14 and a first inner surface 16, the inner surface defining a plurality of openings 18 in fluid communication with the interior 20 of hollow member 12.

A plurality of hollow nozzle elements 22 project inwardly from inner surface 16. Each of nozzle elements 22 defines an inner opening 23 which is in fluid communication with an opening 18. Free ends 24 of nozzle elements 22 are positioned to have an interference fit with the fabric or nap of a paint roller pad when the pad is passed axially between nozzle elements 22, and it is preferred that nozzle elements 22 be of sufficient length and flexibility to penetrate to the base of the nap for the most effective cleaning.

Means 26 are provided in operative relationship with interior 20 for introducing water or other liquid solvent into the interior Means 26, for example, may be a flexible or rigid tube 28 which is connected to annular member 12 in a conventional manner.

An annular sleeve and splash guard 30 is attached to and in substantially coaxial relationship with first annular member 12, and sleeve 30 defines wiping opening 42 defined by a second inner surface 32 having an interference fit with the paint roller pad whereby paint and liquid solvent are wiped and wrung from the roller pad as the pad is passed through sleeve 30 after contacting nozzle elements 22.

Preferably, apparatus 10 includes a second annular member or splash guard 34 attached to and in substantially coaxial relationship with first annular member 12 for reducing and controlling the amount of spray and splashing of liquid and paint as the roller pad is passed through apparatus 10.

Annular sleeve 30 and second annular member 34 are attached to and located on opposite sides of first annular member 12 from each other. Second annular member or splash guard 34 defines a roller pad-receiving opening 36 having a diameter of predetermined size larger than that of opening 42 to provide a non-interference fit with the roller pad whereby the roller pad can be freely passed through opening 36.

Apparatus 10 further includes means 38 in operative relationship with liquid introducing means 26 and tube 28 for connecting a hose to apparatus 10.

Openings 18 and nozzle elements 22 are preferably disposed circumferentially of first inner surface 16, and openings 18 and nozzle elements 22 are substantially equally spaced apart from each other around inner surface 16. Nozzle elements 22 are positioned and are preferably of sufficient dimensions to have an interference fit with base portions of the fabric or nap of the roller pad. Nozzle elements 22 also are preferably of predetermined length and have predetermined tapered diameters so as to be semi-rigid or slightly flexible to permit the nozzle elements to penetrate the nap around the entire circumference of the roller pad as the pad is passed through apparatus 10 whereby liquid from the nozzle elements is applied directly to the base of the nap to effectively flush paint from the roller pad. For example, each of nozzle elements 22 may be seven centimeters long with a diameter of three centimeters at the base of each nozzle element and a diameter of one and one-half centimeters at each free end 24.

In operation, the paint-filled roller pad is passed axially through receiving opening 36 in splash guard 34. Water or other paint solvent is admitted through connection 38 and tube 28 so that the water or solvent is forcefully passed through nozzle elements 22 and openings 23. The roller pad is then moved in an axial direction with respect to annular member 12 so that semi-rigid nozzle elements 22 flexibly engage the base of the nap of the roller pad around the entire circumference of the pad as the roller pad passes between the nozzle elements.

Because nozzle elements 22 are preferably semi-rigid or slightly flexible and are positioned and dimensioned to penetrate substantially to the base of the fabric or nap around the entire circumference of the roller pad, the water or solvent jets emitted from nozzle elements 22 are applied directly to the base of the nap, and paint located at the base of the nap is efficiently flushed out. The semi-rigid or slightly flexible characteristics of nozzle elements 22 are also important to enable the nozzle elements to penetrate to the base of the nap of the roller pad around the entire circumference of the pad while simultaneously enabling the roller pad to be passed axially through apparatus 10 in interference contact with the nozzle elements without undue resistance from the nozzle elements.

Many previously known devices for cleaning paint roller pads fail to apply water directly to the base of the nap or require many time-consuming and messy passes of the pad through the device to clean the pad. Other existing paint roller cleaning devices simply use openings to apply water to the surface of the nap, but such surface application of water to the roller pad results only in so-called "surface erosion" of the paint on the roller pad and does not effectively remove paint from the base of the pad fabric. The force of the water emitted from openings only and without the use of nozzles 22 is dissipated on the surface of the roller pad nap, and the water is not delivered directly to the base of the nap.

Volume 40 in apparatus 10, including the spaces between free ends 24 of nozzles 22 and inner surface 16 and the spaces between ends 24 of nozzles 22 and annular splash control members 30, 34 also enables the water or solvent which has forcefully passed through the fabric or nap to swirl and circulate over the surface of and through the nap of the roller pad in a turbulent cleansing action before the water is directed from the interior of apparatus 10 in a controlled manner by splash guards 30, 34 through openings 36, 42.

The paint roller pad is then axially passed from positions between nozzle elements 22 into engagement with sleeve 30 so that the outer surface of the pad fabric or nap contacts inner surface 32 in an interference fit. As the paint roller is axially moved through annular sleeve 30, inner surface 32 effectively wipes and wrings the paint and water or solvent from the entire roller pad. There is no need to twist or turn the pad as it moves through sleeve 30. Rather, the pad is moved only in the axial direction described, and one pass of the pad through apparatus 10 is typically sufficient to effectively clean the roller pad. Axial movement of the roller pad through sleeve 30 and in contact with inner annular surface 32, which simultaneously contacts the entire circumference of the pad, also has the effect of massaging or rubbing any higher concentrations of excess paint into a more generalized area on the roller pad to prepare the way for a more thorough cleaning of the pad if a second pass of the pad through apparatus 10 is necessary.

Sleeve 30 also acts as a splash guard to reduce and control the amount of water and paint exiting through opening 42 is the roller pad is passed through apparatus 10. Splash guard 34 similarly acts to prevent water and paint from undesirably spattering and splashing from apparatus 10 during the cleaning procedure. The splash guards enable the roller pad to be quickly and effectively cleaned without splashing water, solvent or paint onto the user.

This invention provides for an improved device for cleaning paint roller pads which enables water or paint solvent to be easily, efficiently and effectively applied simultaneously to all surfaces of the pad to flush paint from even the base portions of the fabric of the pad. The invention also quickly, easily and effectively wipes paint from the pad without the need for twisting or turning the pad as it is passed through the device.

The invention in its broader aspects is not limited to the specific details shown and described, and departures may be made from such details without departing from the principles of the invention and without sacrificing its chief advantages.

What is claimed is:

1. Apparatus for cleaning a paint roller pad of predetermined diameter, said apparatus comprising:

a first hollow annular member defining a hollow interior and having an outer surface and a first inner surface, said inner surface defining a plurality of openings in fluid communication with said hollow interior;

a plurality of nozzle elements projecting inwardly from said inner surface and in fluid communication with said openings;

free ends of said nozzle elements positioned to have an interference fit with the nap of a roller pad around the entire circumference of the pad when the pad is placed between said nozzle elements;

means in operative relationship with said hollow interior for introducing liquid into said interior;

an annular sleeve attached to and in substantially coaxial relationship with said first annular member, said sleeve defining a wiping opening defined by a second inner surface having an interference fit with a roller pad, whereby paint and liquid are wiped and wrung from the roller pad as the pad is passed through said sleeve after contact with said nozzle elements; and a second annular member attached to and in substantially coaxial relationship with said first member for reducing and controlling the amount of spray and splashing of liquid and paint as the roller pad is passed through said apparatus.

2. Apparatus as in claim 1 wherein said annular sleeve and said second annular member are located on opposite sides of said first member from each other.

3. Apparatus as in claim 2 wherein said second annular member defines a roller pad-receiving opening have a diameter of predetermined size and larger than said wipening opening to provide a non-interference fit with a roller pad.

4. Apparatus as in claim 3 wherein said plurality of openings in said first inner surface and said nozzle elements are disposed circumferentially of said first inner surface.

5. Apparatus as in claim 4 wherein said plurality of openings in said first inner surface and said nozzle elements are substantially equally spaced apart from each other around said first inner surface.

6. Apparatus as in claim 5 further including means in operative relationship with said liquid introducing means for connecting a hose to said apparatus.

7. Apparatus as in claim 6 wherein said nozzle elements are positioned and of sufficient dimensions to have an interference fit with base portions of the nap of a roller pad and wherein said nozzle elements are semi-rigid to permit said nozzle elements to penetrate to the base of the nap of the roller pad while enabling the roller pad to be passed axially through said apparatus with little resistance from said nozzle elements, whereby liquid from said nozzle elements is applied directly to the base of the nap to effectively flush paint from the roller pad.

8. Apparatus as in claim 1 wherein said nozzle elements are semi-rigid to permit said nozzle elements to penetrate the nap of a roller pad, whereby liquid from said nozzle elements is applied directly to the base of the nap to effectively flush paint from the roller pad.

9. Apparatus as in claim 8 wherein said nozzle elements are positioned to have an interference fit with base portions of the nap of said roller pad.

* * * * *